US007900567B2

(12) United States Patent
Haaga et al.

(10) Patent No.: US 7,900,567 B2
(45) Date of Patent: Mar. 8, 2011

(54) SHIELDING ARRANGEMENT FOR THE SMELT SPOUT AREA OF A RECOVERY BOILER

(75) Inventors: Kari Haaga, Tampere (FI); Hannu Koskela, Tampere (FI); Ari Saarela, Lempäälä (FI)

(73) Assignee: Metso Power Oy, Tampere (FI)

( * ) Notice: Subject to any disclaimer, the term of this patent is extended or adjusted under 35 U.S.C. 154(b) by 573 days.

(21) Appl. No.: 11/502,441

(22) Filed: Aug. 11, 2006

(65) Prior Publication Data

US 2007/0036695 A1 Feb. 15, 2007

(30) Foreign Application Priority Data

Aug. 11, 2005 (FI) ..... 20055432

(51) Int. Cl.
*C21B 7/24* (2006.01)

(52) U.S. Cl. ..... 110/193; 110/173 R; 160/31; 266/174

(58) Field of Classification Search ..... 266/903, 266/174; 108/54.1, 138; 451/455; 160/24, 160/25, 29, 31, 35, 36, 84.03, 84.06; 422/185; 122/504; 110/173 R, 173 A, 193
See application file for complete search history.

(56) References Cited

U.S. PATENT DOCUMENTS

| | | | | |
|---|---|---|---|---|
| 654,516 | A * | 7/1900 | Chapman | 266/174 |
| 1,640,663 | A * | 8/1927 | Mauthe | 266/174 |
| 3,215,099 | A * | 11/1965 | Coulter, Jr. | 110/238 |
| 3,580,556 | A * | 5/1971 | Roscoe | 266/158 |
| 4,269,901 | A * | 5/1981 | Chamberlain | 428/542.8 |
| 4,479,637 | A * | 10/1984 | Sangster et al. | 266/281 |
| 4,761,204 | A | 8/1988 | Kohl et al. | |
| 4,867,677 | A * | 9/1989 | Ulinski | 432/245 |
| 5,461,763 | A * | 10/1995 | Donnelly | 29/81.08 |
| 5,542,650 | A * | 8/1996 | Abel et al. | 266/135 |
| 5,640,747 | A * | 6/1997 | Donnelly | 29/81.08 |
| 5,976,319 | A | 11/1999 | Paju et al. | |
| 2008/0007148 | A1 * | 1/2008 | Trulaske et al. | 312/304 |

FOREIGN PATENT DOCUMENTS

| | | |
|---|---|---|
| BE | 1 014 317 A4 | 8/2003 |
| EP | 1 681 512 A | 7/2006 |
| JP | 02264091 A | 10/1990 |

OTHER PUBLICATIONS

Vakkilainen, Esa, "Development of recovery boiler technology," *Colloquium on Black Liquor Combustion and Gasification*, Park City, Utah, U.S.A., May 16, 2003 (pp. 1-23).

European Patent Search Report, dated Jun. 1, 2007, issued for corresponding European Application No. EP 06 39 7016.

* cited by examiner

*Primary Examiner* — Kenneth B Rinehart
*Assistant Examiner* — David J Laux
(74) *Attorney, Agent, or Firm* — Venable LLP; Eric J. Franklin

(57) ABSTRACT

A method for improving the operation safety of the smelt spout area of a recovery boiler, which smelt spout area comprises a working area (6), as well as smelt spouts (2) connected to the lower part of the boiler for directing the smelt from the boiler to a dissolving tank (4). In the method the smelt spouts (2) are separated from the working area (6) by a shielding wall (8, 10) arranged movable in relation to the smelt spouts. The invention also relates to a smelt spout area of a recovery boiler.

19 Claims, 3 Drawing Sheets

SHIELDING ARRANGEMENT FOR THE SMELT SPOUT AREA OF A RECOVERY BOILER

FIELD OF THE INVENTION

The invention relates to a method for improving the operation safety of the smelt spout area of a recovery boiler and the smelt spout area of a recovery boiler.

BACKGROUND OF THE INVENTION

The spent lye, i.e. the so-called black liquor created in pulp manufacture is burnt in a recovery boiler, on one hand, in order to recover the energy it includes, and on the other hand, in order to recover the chemicals in it and to recycle them back to circulation. A char bed is created on the bottom of the recovery boiler when burning black liquor, which in a high temperature forms into smelt, which is removed from the boiler as a continuous flow via smelt spouts to a dissolving tank.

Below the furnace is located the cover area of the dissolving tank of the recovery boiler, i.e. the smelt spout area, where the smelt from the lower part of the furnace is directed along the so-called smelt spout to the dissolving tank. FIG. 1 shows a typical smelt spout area of a recovery boiler, which comprises smelt spouts 2, along which the smelt is directed from the furnace 3 to the dissolving tank 4.

It is necessary to work in the vicinity of the smelt spouts relatively often, because the operation of the smelt spouts must be monitored at regular intervals. When necessary, pluggings must be removed from the smelt spouts in order for the smelt to be able to travel to the dissolving tank. In addition, the primary air nozzles 5 are often located in the vicinity of the smelt spout area (on the so-called primary register level), in which case checking and adjusting the nozzles requires working in the smelt spout area.

Typically, the smelt is very hot (for example 750 to 820° C.). The possible splashes of smelt cause danger to the personnel working and moving in the vicinity. Because of this, there is typically a protection area near the smelt spouts, moving on which area should be avoided and working on which area requires using special protection equipment.

SUMMARY OF THE INVENTION

The main purpose of the present invention is to disclose a new solution for increasing work safety.

To attain this purpose, the method according to the invention is primarily characterized in that in the method the smelt spouts are separated from the working area by a shielding wall arranged movable in relation to the smelt spouts. The smelt spout area of a recovery boiler according to the invention, in turn, is primarily characterized in that the smelt spout area comprises one or more shielding walls arranged movable in relation to the smelt spout in order to separate the smelt spouts from the working area. The dependent claims will present some preferred embodiments of the invention.

The basic idea of the invention is to arrange a shielding wall in front of the smelt spouts, which can be moved, for example closed and opened. According to the basic idea the closed shielding wall settles between the person working in the working area and the smelt spout. The shielding wall prevents the possible smelt splashes from falling on the person. In an advantageous embodiment the shielding wall also muffles the noise from the smelt spouts towards the working area. In an embodiment the heat radiation radiated from the smelt spouts to the working area is dampened by the shielding wall.

The method according to the invention discloses a solution for improving the operation safety of the smelt spout area of a recovery boiler, which smelt spout area comprises a working area, as well as smelt spouts connected to the lower part of the boiler to direct the smelt from the boiler to a dissolving tank. In the method, the smelt spouts are separated from the working area by a shielding wall that is arranged movable in relation to the smelt spouts. Correspondingly, in a power plant according to the invention, the smelt spout area comprises one or more shielding walls arranged movable in relation to the smelt spout in order to separate the smelt spouts from the working area.

In an embodiment the shielding wall is formed of one or more shielding units arranged movable. The shielding units can move in different directions application-specifically, such as, for example horizontally or vertically.

The movable shielding wall enables different usage, service and maintenance operations requiring a great deal of moving space. In an advantageous embodiment the shielding wall can be opened for a large uniform length.

The shielding wall can be implemented in a variety of ways. Advantageously the wall is formed of several units, in which case handling it is easier than handling large units. For example, the wall may be composed of sliding doors, lattice doors, shutters and/or folding doors. The direction of motion of individual units of the wall depends on the application. For example, the direction of motion can be horizontal or vertical. The wall can also move parallel or perpendicularly in relation to the bank of smelt spouts of the boiler.

In an embodiment the smelt spout area also comprises a service platform arranged movable in relation to the smelt spouts, which platform comprises a shielding wall. The service platform is meant for the usage, service and maintenance operations of targets located higher, such as the primary register level.

The shielding wall advantageously comprises inspection openings, such as, for example, windows and/or hatches that can be opened, through which it is possible to perform, inter alia, visual monitoring, rodding the spouts, as well as other usage, service and maintenance operation. There can be different kinds and shapes of hatches and windows, which provide as optimal as possible user interfaces for different tasks.

By the solution according to the invention, many significant advantages are achieved when compared with the solutions of prior art. The safety of the smelt spout area of a recovery boiler is improved, when the shielding structure separates the smelt spouts from the personnel. The shielding structure can application-specifically prevent different splashes, steams and/or pressure shocks from reaching the working area.

In an application the noise level of the smelt spout area is decreased. Muffling the noise is affected by the design and materials of the shielding structure. Decreased noise level improves work conditions and increases work safety for its part.

In one case the invention, in turn, enables the efficient utilization of the smelt spout area, because the shielding area can be decreased due to the shielding solution and the area that is thus freed can be used efficiently.

DESCRIPTION OF THE DRAWINGS

In the following, the invention will be described in more detail with reference to the appended principle drawings, in which.

For the sake of clarity, the figures only show the details necessary for understanding the invention. The structures and details that are not necessary for understanding the invention, but are obvious for anyone skilled in the art, have been omitted from the figures in order to emphasize the characteristics of the invention.

DETAILED DESCRIPTION OF THE INVENTION

Figure 1:
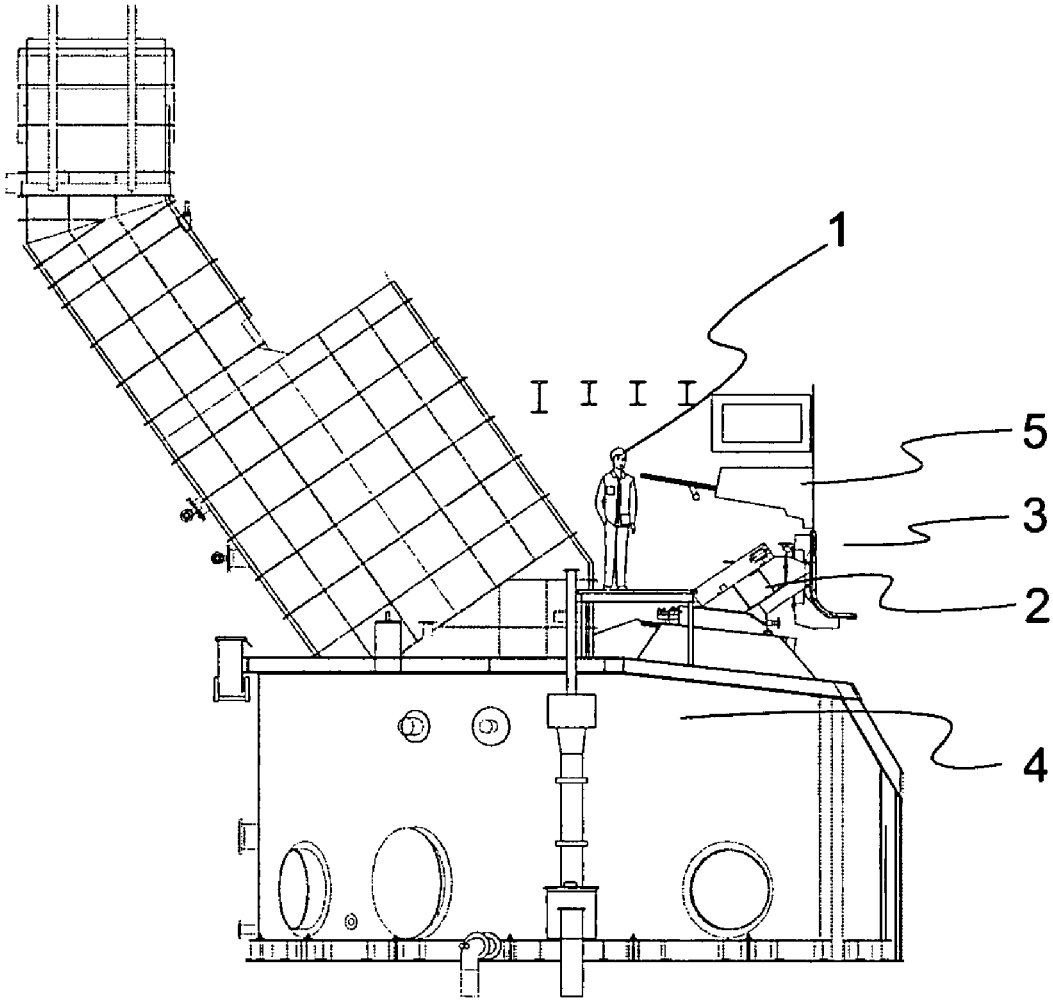
FIG. 1 shows a smelt spout area according to prior art.

FIG. 1 shows a present smelt spout area of a recovery boiler. The area comprises smelt spouts 2, along which the smelt is directed from the furnace 3 to the dissolving tank 4. Generally in boilers the air nozzles 5 of the primary air level are placed above the smelt spouts 2 in such a manner that they can be accessed from the smelt spout area, for example, by means of some platform.

Figure 2:
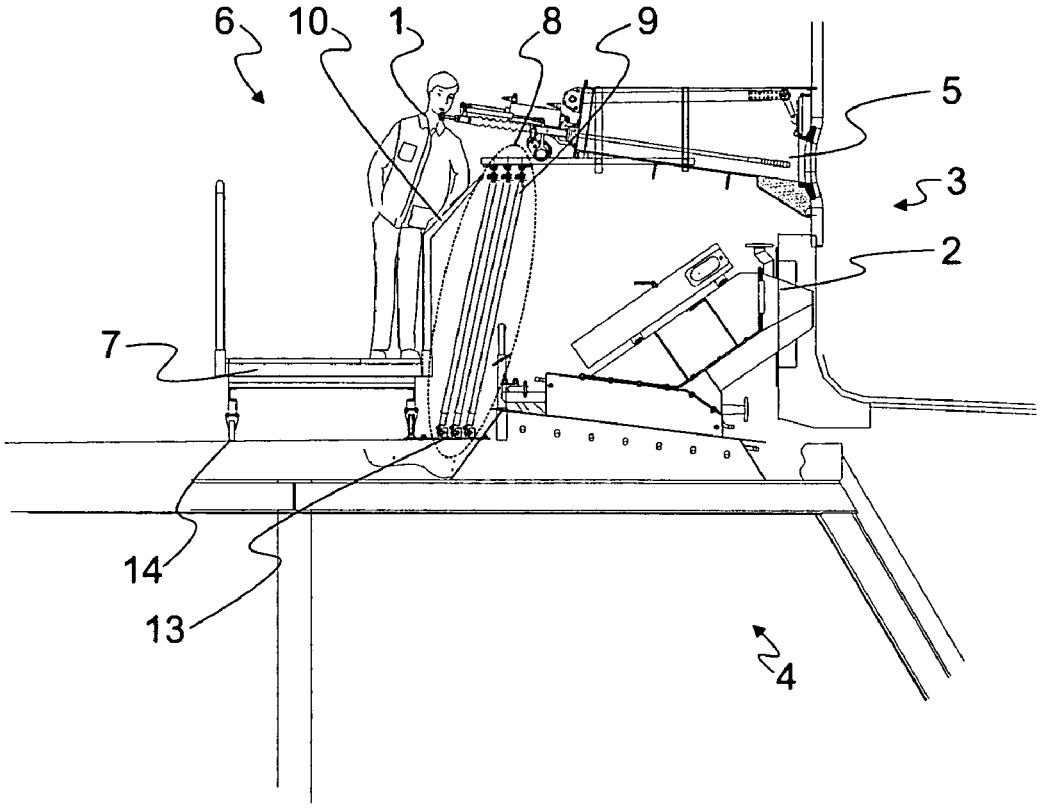
FIG. 2 shows a side view of a smelt spout area according to the invention.

FIG. 2 shows the shielding wall 8 according to the invention in a side view. This direction is the same as the direction of the bank of smelt spouts 2, i.e. the direction of the wall of the boiler. The shielding wall 8 is arranged between the working area 6 and the smelt spouts 2. The working area 6 refers to that area of the smelt spout area, where the personnel works when performing usage, service and maintenance operation. In the case according to FIG. 2, the working area 6 is the area to the left of the shielding wall 8. In FIG. 2, inter alia, a service platform 7 is located in the working area 6, which platform forms its own, smaller working area. As can be seen in FIG. 2, the shielding wall 8 protects the person 1 on the working area 6 by separating the person from a direct contact with the smelt spout 2.

Figure 3:
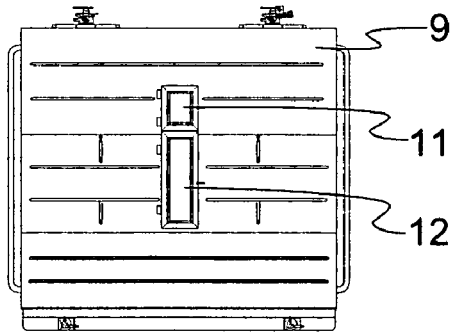
FIG. 3 shows a front view of a shielding wall unit according to the invention.

FIG. 3 shows a shielding unit 9 (shielding module, shielding element) forming the shielding wall 8 in a front view, i.e. when the viewing direction is from the working area 6 towards the smelt spouts 2. In the example, the shielding unit 9 of the shielding wall 8 comprises two windows 11, 12. In the example, the upper one 11 of these windows is fixed and it is intended for performing visual monitoring. The lower window 12 can be opened and closed, and it enables performing the often repeated usage, service and maintenance operation, such as rodding, without having to move the shielding wall 8 to the side. Thanks to the windows 11, 12 the shielding wall 8 does not need to be opened for visual inspection. Thus, the inspection can be performed from a protected space. There may be several hatches and/or windows 11, 12 in the shielding wall 8, or not necessarily any windows and/or hatches at all. The hatches can comprise windows or be solid, depending on the target of use. For example, the shielding wall 8 may comprise a hatch for working and a window for camera monitoring.

Figure 4:
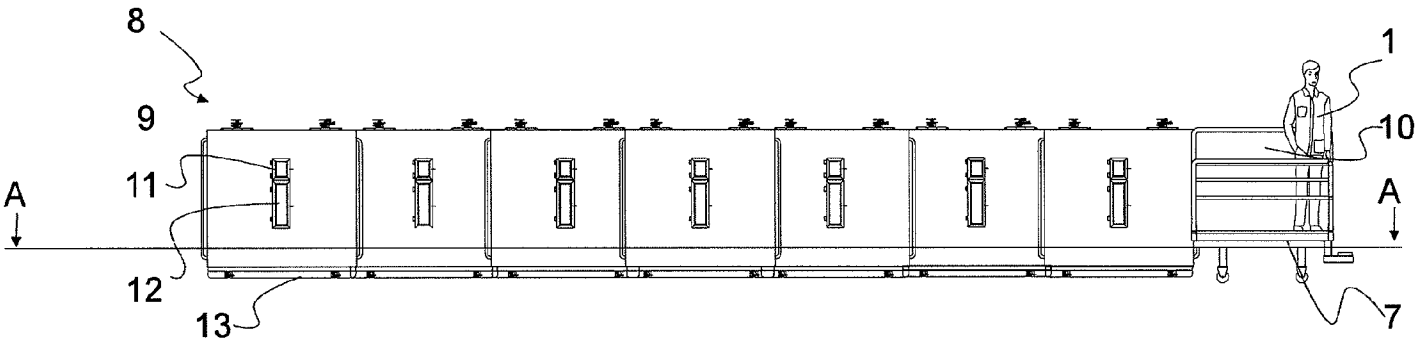
FIG. 4 shows a front view of a shielding wall according to the invention.

FIG. 4 shows an application, where the shielding wall 8 comprises several adjacent shielding units 9 shown in FIG. 3. The shielding wall 8 can comprise one or more shielding units 9. In the example, the shielding units 9 of the shielding wall 8 are certain kind of sliding doors, which can be slid in the direction of the boiler wall. For this purpose there are slide rails 13 at the bottom and top, which enable the sliding. Advantageously there are several adjacent rails 13, such as, for example, three or four rails, in which case when opening the wall it is possible to slide several doors adjacently into a bundle and thus form a larger opening. This has been aimed to be illustrated in FIG. 5, which shows the application of FIG. 4 in a top view along line A-A.

Figure 5:
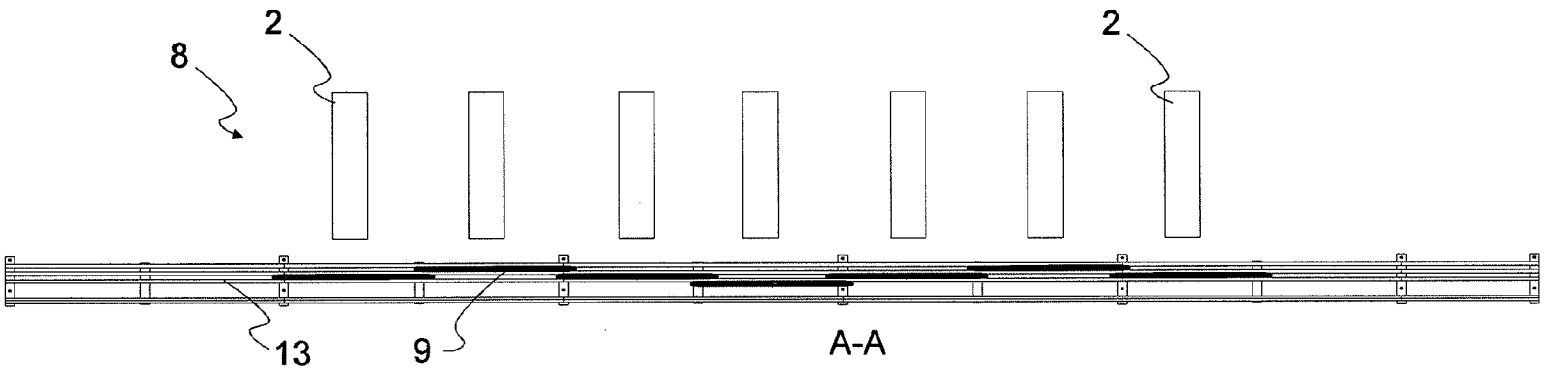
FIG. 5 shows the shielding wall of FIG. 4 along line A-A.

By opening the shielding wall 8 partly or entirely is created a large and as clear as possible passage to the area behind the line formed by the shielding wall 8, such as, for example, to the smelt spouts 2. Thus, it is easier to perform more extensive usage, service and maintenance operation. As can be seen in FIG. 5, the opening of the shielding wall 8 can be performed by moving the shielding units 9 along the rails 13. The shielding units 9 on different rails 13 can be mutually placed in such a manner that the second shielding unit is located behind the first shielding unit. The details connected to opening and closing the shielding wall 8 naturally depend on the structure of the shielding wall.

The opening and closing may, for example, be based on overlapping, folding and/or removing.

In an application the attachment of the shielding unit 9 of the shielding wall 8 is arranged with a quick clamping, which enables the easy and fast detachment, and if necessary, the removal and/or changing of the shielding unit.

The shielding wall 8 may application-specifically be located on different sides of the boiler (on one or more sides). In a power plant application the shielding wall 8 is on those sides of the boiler where the smelt spouts 2 are located. In another power plant application the shielding wall 8 is placed around the boiler.

The structure of the shielding wall 8 and the individual shielding units 9 may vary application-specifically. Some possible solutions include different kinds of sliding doors, lattice doors, folding doors, roller shutters, etc. In addition, the direction of motion of the shielding units 9 may vary application-specifically. In the previous example the direction of motion of the shielding units 9 is horizontal and in the direction of the boiler wall. In another application the direction of motion of the shielding unit 9 is substantially perpendicular to the boiler wall. In an application the direction of motion of the shielding unit 9 is substantially vertical. In an application the direction of motion of the movement taking place vertically is, in turn, slanted. Especially different curtain-type shielding walls 8 are advantageous to be arranged to move upwards, preferably vertically if possible, in which case the structure does not necessarily have to be rigid in order to control the movement of the shielding wall 8. The movement of the shielding wall 8 can also be controlled by different solutions, such as, for example, rolls, glides, guide bars, hinges and junction structures.

In selecting the material for the shielding wall 8 it is advantageous to pay attention to, inter alia, thermal resistance and the resistance of the occurring chemicals. The shielding wall 8 should be incombustible and preferably sound-insulating. Because of ease of processing the shielding units 9 of the shielding wall 8 should be light, which, in addition to the materials, is affected by the size and shape of the shielding unit. In some tests a shielding wall 8 manufactured of stainless steel has been detected to be useful. Its sound-insulation can be improved with different sound-insulating materials. There are also other alternatives, such as, for example structures manufacture entirely or partly of metal, composite or ceramic.

The shielding wall 8 must also endure great temperature fluctuations, which occur, inter alia, in connection with the start-up and shutdown of the boiler. Thermal radiation of the boiler causes the dimensions of the shielding wall 8 to change. In addition, a change in the temperature of the shielding wall 8 causes the dimensions to change in its structure. For easy handling the shielding wall 8 must enable the thermal expansion of both the shielding wall and other structures. The changes caused by thermal expansion affecting the shielding wall 8 may be several tens of centimeters in size. The shielding wall 8 can, for example, be implemented in such a manner that its structure is flexible or its structure increases and decreases according to need. It is also possible that the attachment solution enables thermal radiation.

The space around the boiler defined by the shielding wall can be substantially solid or breathing. A breathing structure can be implemented in a variety of ways. The shielding wall 8 can, for example, be formed in such a manner that air can flow between the shielding units 9 of the shielding wall. It is also possible to use different breather and valve structures for pressure balancing. The flow of air and other gases can also be controlled with various types of channel structures. For example, a pipe can be lead to the outside from the space defined around the boiler by the shielding wall 8. Different pressure shocks may occur in the space in question, for example, when a malfunction is created in the smelt spout 2, such as, for example, a smelt flush.

FIGS. 2 and 4 show a service platform 7 as well. In the example, the service platform 7 is intended for the usage, service and maintenance operation of the so-called primary register level. In the example according to the figure, the primary register level is above the smelt spouts 2 and it comprises, inter alia, primary air nozzles 5. The service platform 7 is arranged to be movable. In the example, the service platform 7 comprises wheels, which are located in the rails 14 in the floor. The path of the service platform 7 is controlled by means of the rails 14. It is also possible to arrange the service platform 7 to be movable in another manner. Moving the service platform 7 and/or the shielding wall 8 may application-specifically take place either manually and/or with engine power, such as, for example, by electric motor usage.

The shielding wall 8 described above protects the person 1 on the service platform 7. It is also possible to arrange a shielding wall 10 in connection with the service platform 7. Thus, the shielding wall 10 moves along with the service platform 7 always being between the working area of the service platform and the smelt spouts 2, thus protecting the working area. The shielding wall 10 of this service platform 7 can also be equipped with different hatches and windows, for example, as has been described above. The size and appearance of the shielding wall 10 of the service platform may vary depending on the target of use.

The shielding effect of the shielding wall 8, as well as work safety can be improved by arranging the devices in the smelt spout area in advantageous positions. By designing the primary air nozzles 5 for example smaller, the working position is made safer and more ergonomic. As can be seen in FIG. 2, by arranging the first side of the air nozzle 5 (the side opposite to the side connected to the furnace) close to the vertical line formed by the shielding wall 8, the person 1 does not have to reach as much as in solutions of prior art.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims hereinbelow.

The invention claimed is:

1. A smelt spout area of a recovery boiler, comprising:

a bank of smelt spouts connected to a lower part of the boiler for directing smelt from the boiler to a dissolving tank;

a working area in front of the bank of smelt spouts; and a shielding wall located in front of the bank of smelt spouts and arranged movable in relation to the bank of smelt spouts to separate the bank of smelt spouts from the working area and persons working on the working area, wherein the shielding wall comprises at least one hatch for rodding the smelt spout through the shielding wall during a service and maintenance operation.

2. The smelt spout area of a recovery boiler according to claim 1, wherein the shielding wall comprises a plurality of movable shielding units.

3. The smelt spout area of a recovery boiler according to claim 2, wherein the shielding units are horizontally movable.

4. The smelt spout area of a recovery boiler according to claim 2, wherein the shielding units are vertically movable.

5. The smelt spout area of a recovery boiler according to claim 1, wherein the shielding wall comprises a plurality of shielding units each comprising at least one of: a sliding door, a lattice door, a folding door, a roller shutter.

6. The smelt spout area of a recovery boiler according to claim 1, wherein the shielding wall comprises at least one window for visually monitoring the bank of smelt spouts through the shielding wall.

7. The smelt spout area of a recovery boiler according to claim 1, wherein the shielding wall comprises at least one hatch for rodding the smelt spout through the shielding wall during a service and maintenance operation.

8. The smelt spout area of a recovery boiler according to claim 1, further comprising:

a service platform located in the working area and arranged movable in relation to the bank of smelt spouts, wherein the service platform comprises a shielding wall located between the bank of smelt spouts and the service platform.

9. The smelt spout area of a recovery boiler according to claim 8, wherein the shielding wall of the service platform comprises at least one window.

10. The smelt spout area of a recovery boiler according to claim 8, wherein the service platform shielding wall of the service platform comprises at least one hatch that can be opened and closed.

11. The smelt spout area of a recovery boiler according to claim 1, further comprising:

primary air nozzles of the recovery boiler, wherein the primary air nozzles are located above the bank of smelt spouts and above the shielding wall, and wherein the primary air nozzles are accessible by a person on the working area.

12. The smelt spout area of a recovery boiler according to claim 1, further comprising:

a service platform located in the working area and arranged movable in relation to the bank of smelt spouts, primary air nozzles of the recovery boiler, wherein the primary air nozzles are located above the bank of smelt spouts and above the shielding wall, and wherein the primary air nozzles are accessible by a person on the service platform.

13. The smelt spout area of a recovery boiler according to claim 2, wherein the plurality of shielding units is configured to provide a closed shielding wall to prevent splashes, steams or pressure shocks of the bank of smelt spouts from reaching the working area.

14. The smelt spout area of a recovery boiler according to claim 13, wherein the shielding units overlap each other.

15. The smelt spout area of a recovery boiler according to claim 1, wherein the shielding wall comprises sound-insulating material.

16. The smelt spout area of a recovery boiler according to claim 1, wherein the shielding wall is configured to provide a closed shielding wall to prevent splashes, steams, or pressure shocks of the bank of smelt spouts from reaching the working area.

17. A smelt spout area of a recovery boiler, comprising:

a bank of smelt spouts connected to a lower part of the boiler for directing smelt from the boiler to a dissolving tank;

a working area in front of the bank of smelt spouts; and a shielding wall located in front of the bank of smelt spouts and arranged movable in relation to the bank of smelt spouts to separate the bank of smelt spouts from the working area and persons working on the working area;

wherein at least one of the shielding units comprises a window for monitoring visually the smelt spout through the shielding unit, and a hatch for rodding the smelt spout through the shielding unit during a service and maintenance operation, and wherein the shielding wall comprises a plurality of shielding units arranged horizontally movable in relation to the bank of smelt spouts.

18. The smelt spout area of a recovery boiler according to claim 17, wherein the plurality of shielding units comprises:

a first movable shielding unit separating the bank of smelt spouts from the working area;

a second movable shielding unit separating the bank of smelt spouts from the working area; and a third movable shielding unit located between the first shielding unit and the second shielding unit, wherein the third movable shielding unit when closed separates the bank of smelt spouts and a smelt spout of the bank of smelt spouts from the working area, and wherein the third movable shielding unit when opened enables performing service and maintenance operations related to said smelt spout.

19. The smelt spout area of a recovery boiler according to claim 17, wherein the shielding wall further comprises:

a plurality of adjacent rails at the bottom and top of the shielding wall and along which the plurality of shielding units slides such that, for opening and closing the shielding wall, a shielding unit on a rail can be placed behind another shielding unit on another rail.

* * * * *